US006621030B2

(12) United States Patent
Andou et al.

(10) Patent No.: US 6,621,030 B2
(45) Date of Patent: Sep. 16, 2003

(54) GAS-INSULATED SWITCHGEAR

(75) Inventors: Tomoyuki Andou, Hitachi (JP); Junzo Kida, Hitachi (JP); Makoto Hirose, Hitachi (JP); Osamu Koyanagi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/101,206

(22) Filed: Mar. 20, 2002

(65) Prior Publication Data

US 2003/0094436 A1 May 22, 2003

(30) Foreign Application Priority Data

Nov. 19, 2001 (JP) ..... 2001-353558

(51) Int. Cl.[7] ..... H01H 33/56
(52) U.S. Cl. ..... 218/43; 174/14 R
(58) Field of Search ..... 218/155, 68, 43; 361/604, 612, 618; 174/14 R

(56) References Cited

U.S. PATENT DOCUMENTS 5,798,484 A * 8/1998 Yamagiwa et al. ..... 174/14 R

FOREIGN PATENT DOCUMENTS

JP 10-234113 * 9/1998 ..... H01H/33/57

* cited by examiner

*Primary Examiner*—Elvin Enad
*Assistant Examiner*—M. Fishman
(74) *Attorney, Agent, or Firm*—Crowell & Moring LLP

(57) ABSTRACT

A gas-insulated switchgear includes a sealed vessel filled with an insulating gas, a circuit breaker held in the sealed vessel, and a branch pipe attached to a lower part of the sealed vessel right below the circuit breaker. The branch pipe defines a hand hole for use in inspecting the circuit breaker, provides a place for installing an absorbent container and forms a foreign matter collecting space.

6 Claims, 2 Drawing Sheets

GAS-INSULATED SWITCHGEAR

BACKGROUND OF THE INVENTION

The present invention relates to a highly reliable gas-insulated switchgear and, more particularly, to a gas-insulated switchgear suitable for use as a puffer type gas-blast circuit breaker.

A general gas-insulated switchgear has a breaker including a stationary contact and a movable contact, a sealed vessel containing the breaker and filled with an insulating gas, such as sulfur hexafluoride gas ($SF_6$), a contact operating device disposed outside the sealed vessel to operate the movable contact, a high-tension conductor connected to the breaker, an insulating spacer connected to the breaker, and buses.

It is possible that foreign matters are produced in the sealed vessel during the assembly of the gas-insulated switchgear or when the breaker exercises its function. If the foreign matters produced in the sealed vessel are conductive, it is possible that the dielectric ability of the insulating gas and the surfaces of insulators is deteriorated.

Various methods have been proposed to prevent the adverse effect of conductive foreign matters on the performance of the breaker in a case where the conductive foreign matters are produced in the sealed vessel. For example, a method proposed in JP-A No. 234113/1998 installs foreign matter catching vessels at a plurality of parts of a sealed vessel filled with an insulating gas and holding a breaker therein, corresponding to nodes of vibration to catch foreign matters when the sealed vessel is shook by the circuit-breaking action of the breaker.

Foreign matters produced in the sealed vessel tend to gather in the nodes of vibration. Therefore, the foreign matters are caught efficiently by the foreign matter catching vessels disposed at the nodes and, consequently, the deterioration of the dielectric ability by conductive foreign matters can be prevented.

However, the prior art method does not give any consideration to a fact that the sealed vessel of the gas-insulated switchgear needs many incidental devices, and have problems in manufacture and cost. Although the prior art method disposes the foreign matter catching vessels at the nodes of vibration, the gas-insulated switchgear needs an absorbent to be placed in all the gas compartments, and the gas-insulated switchgear must be provided with a hand hole for inspecting the breaker.

Nevertheless, the prior art method does not give any consideration to providing the absorbent and forming a hand hole. Thus, some other parts for holding the absorbent must be formed by connecting branch pipes or the like to the sealed vessel, which makes the construction of the gas-insulated switchgear complicated and invokes problems in manufacture and cost. Many branch pipes connected to the sealed vessel spoils the appearance of the gas-insulated switchgear.

SUMMARY OF THE INVENTION

Accordingly, it is an object of the present invention to provide a gas-insulated switchgear capable of being easily and economically manufactured and of facilitating work for maintenance and inspection, and excellent in electrical insulating performance.

A gas-insulated switchgear according to one aspect of the present invention includes a sealed vessel filled with an insulating gas; a circuit breaker held in the sealed vessel; and a branch pipe attached to a lower part of the sealed vessel right below the circuit breaker; wherein the branch pipe defines a hand hole for use in inspecting the circuit breaker, provides a place for installing an absorbent container and forms a foreign matter collecting space.

DESCRIPTION OF THE PREFERRED EMBODIMENTS

Figure 1:
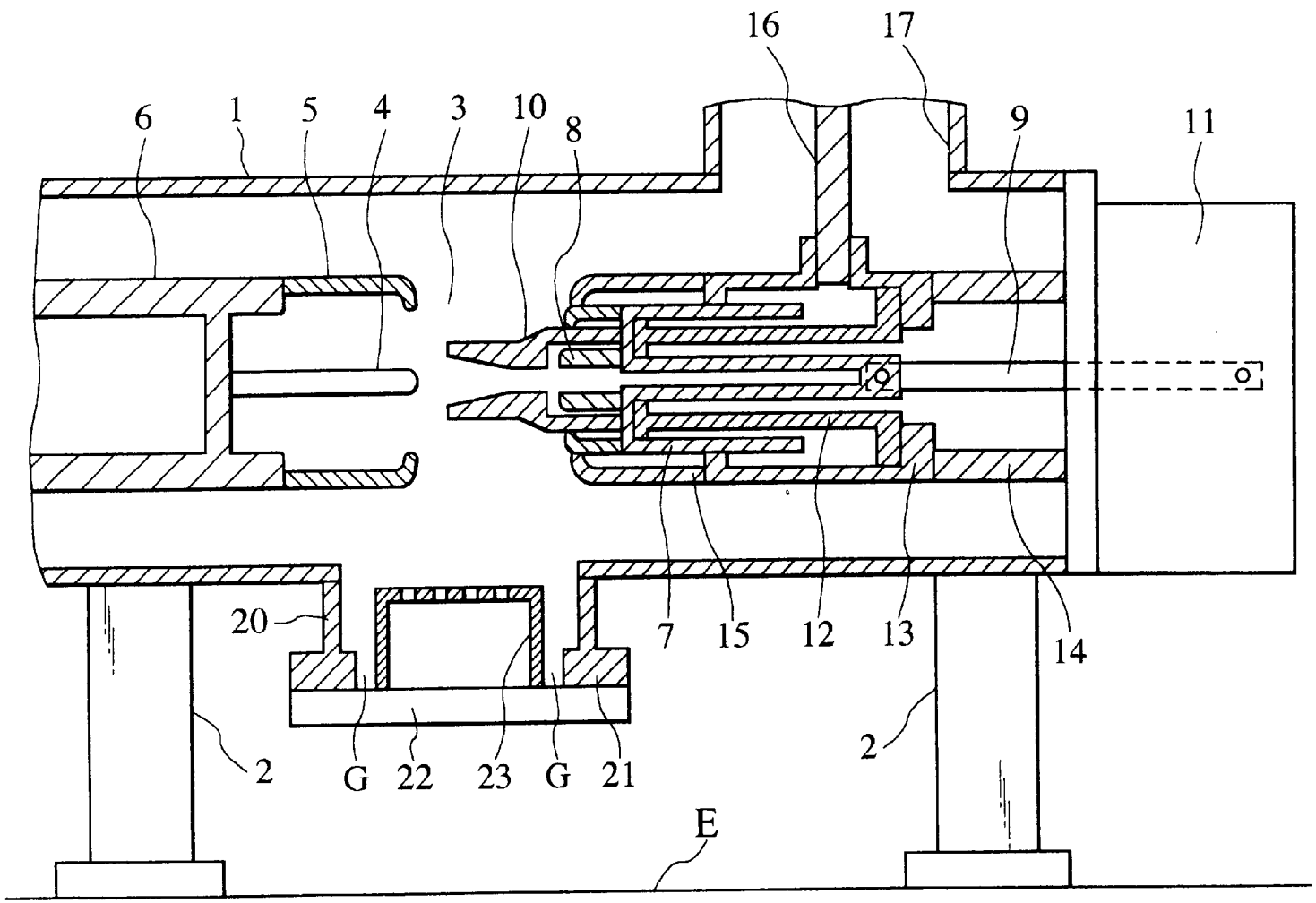
FIG. 1 is a longitudinal sectional view of a gas-insulated switchgear in a preferred embodiment according to the present invention as a puffer type gas-blast circuit breaker.

Referring to the FIG. 1 showing a gas-insulated switchgear in a preferred embodiment according to the present invention as a puffer type gas-blast circuit breaker, a sealed vessel 1 containing an insulating gas is supported by support members 2 on a base E or on an apparatus. A puffer type gas-blast circuit breaker 3 is built in the sealed vessel 1.

The puffer type gas-blast circuit breaker 3 has a stationary-contact unit including a stationary contact 4 and a main stationary contact 5 surrounding the stationary contact 4. The stationary contact 4 and the main stationary contact 5 are attached to a free end of a stationary conductor 6. The stationary conductor 6 is electrically connected to a bus supported on insulating support members not shown in the figure.

The gas-blast circuit breaker 3 has a movable-contact unit including a movable contact 8 formed integrally with a puffer cylinder 7. An insulator-operating rod 9 is connected to the puffer cylinder 7. An insulating nozzle 10 is attached to the puffer cylinder 7 so as to surround the movable contact 8.

The insulator-operating rod 9 is extended through an end part on the side of the movable-contact unit of the sealed vessel 1 and is connected to a movable contact-operating device 11 disposed outside the sealed vessel 1. The movable contact operating device 11 moves the insulator operating rod 9 in axial directions, i.e., lateral directions as viewed in the figure, to bring the movable contact 8 into contact with the stationary contact 4 and to disconnect the movable contact 8 from the stationary contact 4.

A stationary piston 12 is attached to a conductive member 13 of the movable-contact unit so as to define a puffer chamber together with the puffer cylinder 7. The conductive member 13 of the movable-contact unit has one end on the side of the movable-contact unit fixedly attached to an insulating holding tube 14 fixed to the end part on the side of the movable-contact unit of the sealed vessel 1. A main movable contact 15 is attached to the other end of the conductive member 13. A high-tension conductor 16 is attached to an upper part of the conductive member 13 of the movable-contact unit so as to extend upward.

An upper branch pipe 17 is extended upward from an upper part of the sealed vessel 1. The conductive member 13 is connected to a gas bus or a bushing by the high-tension conductor 16.

A short lower branch pipe 20 provided with a flange 21 is extended downward from a lower part of the sealed vessel 1 corresponding to the puffer type gas-blast circuit breaker 3. A lid 22 is detachably attached to the flange 21 to close the open end of the lower branch pipe 20. An absorbent container 23 is detachably attached to the inner surface of the lid 22.

The lower branch pipe 20 is formed in a size and a shape (a circular shape in most cases) such that the operator's hand or arm can be inserted through the lower branch pipe 20 in the sealed vessel 1 to take parts out of and to put parts into the sealed vessel when the operator changes parts of the circuit breaker. Thus the lower branch pipe 20 serves also as a hand hole. The absorbent container 23 is a perforated box capable of containing a sufficient quantity of an absorbent for absorbing moisture contained in the sealed vessel 1 and cracked gases produced in the sealed vessel 1.

The respective sizes of the lower branch pipe 20 and the absorbent container 23 are determined so that a gap G of a predetermined size is formed between the outside surface of the absorbent container 23 and the inside surface of the lower branch pipe 20.

The operation of the gas-insulated switchgear in the preferred embodiment will be explained hereinafter. When breaking a circuit, the puffer type gas-blast circuit breaker 3 blows the compressed insulating gas, such as sulfur hexafluoride gas ($SF_6$) against an electric arc formed between the stationary contact 4 and the movable contact 8 in the puffer cylinder 7 to intercept an electric current.

Therefore the movable-contact-operating device 11 needs to exert a considerably large operating force on the operating rod 9. Consequently, the puffer type gas-blast circuit breaker 3 and the movable contact-operating device 11 vibrate when the movable contact-operating device 11 operates to break the circuit. The vibration of the puffer type gas-blast circuit breaker 3 and the movable contact operating device 11 is transmitted to the sealed vessel 1. If conductive foreign matters are contained in the sealed vessel 1, the conductive foreign matters will move around in the sealed vessel when the sealed vessel vibrates.

Since the components including the puffer type gas-blast circuit breaker 3 and held in the sealed vessel are charged at a high voltage, the conductive foreign matters will float in the sealed vessel.

In the gas-insulated switchgear in the embodiment, the lower branch pipe 20 is connected to the lower part of the sealed vessel 1 right below the puffer type gas-blast circuit breaker 3 so as to define the gap G. Therefore foreign matters once fall into the lower branch pipe 20 and accumulate in the gap G and will not be cause to float again by the vibration transmitted to the sealed vessel 1 and the puffer type gas-blast circuit breaker 3 charged at a high voltage.

The length of the lower branch pipe 20 is determine such that the gap G has a depth that is effective in preventing foreign matters accumulated in the gap G from being caused to float again by the vibration transmitted to the sealed vessel 1 and the puffer type gas-blast circuit breaker 3 charged at a high voltage.

Thus, conductive foreign matters moving in the sealed vessel 1 fall into the lower branch pipe 20 attached to the lower part of the sealed vessel 1 right below the puffer type gas-blast circuit breaker 3 and are collected easily in the gap G. Since the gap G extends over the lid 22 attached to the lower end of the lower branch pipe 20, the same can be formed in a considerably big depth, and hence the foreign matters accumulated in the gap G are not caused to move by the high voltage applied to the puffer type gas-blast circuit breaker 3.

The gas-insulated switchgear has a highly reliable insulating ability. Since the lower branch pipe 20 can be used as a hand hole for use in insecting the puffer type gas-blast circuit breaker 3, the sealed vessel 1 does not need any other hand hole.

The absorbents container 23 containing the absorbent for absorbing moisture and cracked gases is placed in the lower branch pipe 20 and is attached to the inner surface of the lid 22. Therefore the sealed vessel 1 does not need any other branch pipe for containing the absorbent. Thus, the gas-insulated switchgear of the present invention is simple in construction and is capable of being easily and economically manufactured.

Since the absorbent container 23 is detachable from the lid 22, the absorbent container 23 can be easily replaced with a new one, when necessary, by removing the lid 22 from the lower branch pipe 20 to maintain the high reliability of the gas-insulated switchgear.

A gas-insulated switchgear in a modification of the gas-insulated switchgear shown in FIG. 1 will be described with reference to FIG. 2, in which parts like or corresponding to those of the gas-insulated switchgear shown in FIG. 1 are denoted by the same reference characters and the description thereof will be omitted.

Figure 2:
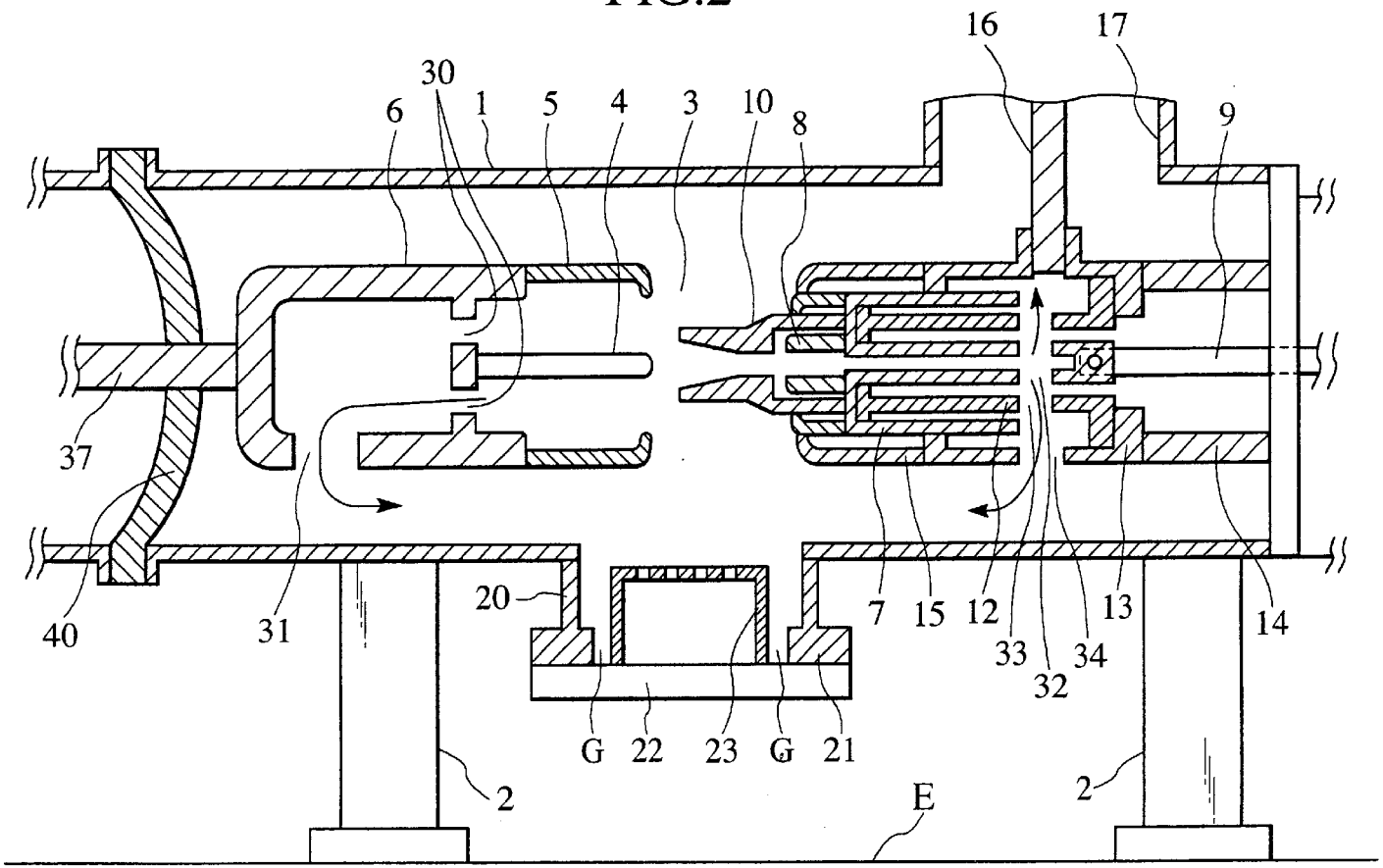
FIG. 2 is a longitudinal sectional view of a gas-insulated switchgear in a modification of the gas-insulated switchgear shown in FIG. 1.

Referring to FIG. 2, a stationary conductor 6 is connected to a conductor 37. The conductor 37 is supported in a sealed vessel 1 by an insulating support 40 to hold the stationary conductor 6 fixedly in the sealed vessel 1. A stationary contact 4 is supported on the stationary conductor 6. The stationary conductor 6 has an opening 30. An insulating gas, such as $SF_6$ gas, blowing toward the stationary conductor 6 when a movable contact 8 is disconnected from the stationary contact 4 flows through the opening 30. An opening 31 is formed in a part on the side of a base E of the stationary conductor 6.

The insulating gas generated when the movable contact 8 is disconnected from the stationary contact 4 passes through the opening 30 and blows against the wall, connected to the conductor 37, of the stationary side conductor 6, thereby being deflected to flow through the opening 31 into the sealed vessel 1. Since the insulating gas flows through the opening 31 toward a branch pipe 20, foreign matters produced when the movable contact 8 is disconnected from the stationary contact 4 are carried by the insulating gas into a gap G.

A puffer cylinder 7 is provided with an opening 32. A stationary piston 12 is provided with an opening 33, and a movable conductor 13 is provided with an opening 34.

The insulting gas blows toward an insulating nozzle 10 when the movable contact 8 is disconnected from the stationary contact 4, and the insulating gas flows through a central part of a puffer cylinder 7 toward an operating rod 9. The insulating gas blows against the wall, connected to the operating rod 9, of the puffer cylinder 7, thereby being deflected. The deflected insulating gas flows through the opening 32 of the puffer cylinder 7, the opening 33 formed in the stationary piston 12 and the opening 34 formed in the movable conductor 13 into the sealed vessel 1.

The insulating gas flowing through the opening 34 flows toward the branch pipe 20. Consequently, foreign matters produced when the movable contact 8 is disconnected from the stationary contact 4 is carried by the insulating gas into the gap G.

Although the insulating gas flows from the puffer cylinder 7 via the stationary piston 12, and the opening 34 of the movable conductor 13 in this embodiment, the movable conductor 13 may be provided with two openings arranged in a vertical direction with respect to the base E, and two openings arranged in a horizontal direction with respect to the base E may be formed in the puffer cylinder 7 and the stationary piston 12 to make the insulating gas flowing through the openings 32 and 33 of the puffer cylinder 6 and the stationary piston 12 flow through the opening 34 of the movable conductor 13 into the sealed vessel 1 in order that the foreign matters produced when the movable contact 8 is disconnected from the stationary contact 4 can be removed from the insulating gas.

When the openings of the movable conductor 13 are arranged in a horizontal direction and the openings of the puffer cylinder 7 and the stationary piston 12 are arranged in a vertical direction, foreign matters contained in the insulating gas can be collected in the gap G.

Thus, foreign matters produced when the movable contact 8 is disconnected from the stationary contact 4 can be carried by the insulating gas from both the stationary conductor and the movable contactor into the gasp G.

Since the sealed vessel 1 is provided only with the upper branch pipe 17 and the lower branch pipe 20, the gas-insulated switchgear has a simple, aesthetically satisfactory appearance from the viewpoint of industrial design.

Although the invention has been described in its preferred embodiment with a certain degree of particularity, obviously many changes and variations are possible therein. It is therefore to be understood that the present invention may be practiced otherwise than as specifically describe herein without departing from the scope and spirit thereof.

What is claimed is:

1. A gas-insulated switchgear comprising:

a sealed vessel filled with an insulating gas;

a circuit breaker held in the sealed vessel; and a branch pipe attached to a lower part of the sealed vessel right below the circuit breaker;

wherein the branch pipe defines a hand hole for use in inspecting the circuit breaker, provides a place for installing an absorbent container and forms a foreign matter collecting space, said absorbent container being configured as a perforated box sized to contain a quantity of absorbent sufficient for absorbing moisture contained in the sealed vessel.

2. A gas-insulated switchgear according to claim 1, further comprising a lid detachably attached to an open end of the branch pipe.

3. A gas-insulated switchgear according to claim 2, wherein the absorbent container is detachably arranged on the lid.

4. A gas-insulated switchgear according to claim 3, wherein the respective sizes of the branch pipe and the absorbent container are determined so that a gap of a predetermined size is formed between the outside surface of the absorbent container and the inside surface of the branch pipe.

5. The gas-insulated switchgear according to claim 1 further comprising:

a stationary contact; and a movable contact, wherein an insulating gas blowing when the movable contact is disconnected from the stationary contact is allowed to flow toward the branch pipe.

6. A gas-insulated switchgear comprising:

a sealed vessel filled with an insulating gas;

a circuit breaker held in the sealed vessel; and a branch pipe attached to a lower part of the sealed vessel right below the circuit breaker;

wherein the branch pipe defines a hand hole for use in inspecting the circuit breaker, provides a place for installing an absorbent container and forms a foreign matter collecting space, the respective sizes of the branch pipe and the absorbent container are determined so that a gap of a predetermined size is formed between the outside surface of the absorbent container and the inside surface of the branch pipe, the absorbent container is configured as a perforated box, and the gap is sized to have a depth sufficient to prevent foreign matter therein from leaving the gap.

* * * * *